US007761960B2

(12) United States Patent
Feile

(10) Patent No.: US 7,761,960 B2
(45) Date of Patent: Jul. 27, 2010

(54) INSERT TONGUE FOR A SAFETY BELT BUCKLE

(75) Inventor: Herbert Feile, Schwaebisch Gmuend (DE)

(73) Assignee: TRW Automotive GmbH, Alfdorf (DE)

( * ) Notice: Subject to any disclaimer, the term of this patent is extended or adjusted under 35 U.S.C. 154(b) by 0 days.

(21) Appl. No.: 11/901,036

(22) Filed: Sep. 14, 2007

(65) Prior Publication Data

US 2008/0066271 A1 Mar. 20, 2008

(30) Foreign Application Priority Data

Sep. 20, 2006 (DE) ..... 10 2006 044 819
Dec. 19, 2006 (DE) ..... 10 2006 060 051

(51) Int. Cl.
*A44B 11/26* (2006.01)

(52) U.S. Cl. ..... 24/198; 24/265 BC; 24/633

(58) Field of Classification Search ..... 24/198, 24/633, 265 BC; 280/801.1, 808; 297/468, 297/483, 484

See application file for complete search history.

(56) References Cited

U.S. PATENT DOCUMENTS 3,982,769 A * 9/1976 Farlind ..... 297/475
4,871,190 A * 10/1989 Willey ..... 280/801.1
4,878,272 A * 11/1989 Kotikovsky et al. ..... 24/196
6,449,811 B1 * 9/2002 Tokugawa ..... 24/198
6,490,764 B1 * 12/2002 Bell ..... 24/198

* cited by examiner

*Primary Examiner*—James R Brittain
(74) *Attorney, Agent, or Firm*—Tarolli, Sundheim, Covell & Tummino LLP

(57) ABSTRACT

An insert tongue (10) for a safety belt buckle includes an insert section (12) which is intended to be inserted into the belt buckle and a safety belt section (14) which has a slot for receiving the safety belt (5). The safety belt section (14) generally extends in the extension of the insert section (12) and the slot extends at an angle of less than 25° relative to a plane defined by the insert section (12).

15 Claims, 5 Drawing Sheets

INSERT TONGUE FOR A SAFETY BELT BUCKLE

TECHNICAL FIELD

The invention relates to an insert tongue for a safety belt buckle, including an insert section which is intended to be inserted into the belt buckle, and a safety belt section which has a slot for receiving the safety belt, the safety belt section generally extending along an extension of the insert section.

BACKGROUND OF THE INVENTION

One requirement of such an insert tongue is that the insert section protrudes from the safety belt to the minimum possible extent, when the safety belt is not fastened and the insert tongue hangs loosely on the safety belt. This will briefly be explained with the aid of FIG. 6. FIG. 6 shows a perpendicularly extending section of a safety belt 5, on which an insert tongue 10 is disposed. This insert tongue 10 consists of an insert section 12 which is intended to be inserted into a belt buckle, and a safety belt section 14 which is provided with a slot for receiving the safety belt 5, the slot not being visible in this figure. It is apparent that the insert section 12 extends at a comparatively large angle relative to the safety belt and therefore protrudes laterally.

To ensure that the insert section 12 protrudes less from the safety belt 5, when the insert tongue is not used, it is known to bend off the safety belt section 14 of the insert tongue 10, hence to bend it relative to the insert section 12. Such a design is schematically shown in FIG. 7. It is apparent that the insert section 12 is positioned comparatively closely to the safety belt 5.

Disadvantageous with the insert tongue shown in FIG. 7 is that the safety belt section 14 limits the free seating capacity for a vehicle occupant. This is schematically represented in FIG. 8. There is shown a safety belt buckle 7, into which the insert tongue 10 is inserted. The free distance A between the safety belt section 14 of the insert tongue 10 and another limitation of the seating capacity, for example the side wall of a vehicle, is smaller than in the case of an insert tongue, the safety belt section 14 of which extends in the extension of the insert section 12 (see FIG. 9).

It is an object of the invention to create an insert tongue whose insert section is positioned as closely to the safety belt as possible, when the insert tongue is not used, the available seating capacity being, however, not limited, when the insert tongue is inserted into a belt buckle.

BRIEF SUMMARY OF THE INVENTION

According to the invention, this is achieved by an insert tongue for a safety belt buckle, including an insert section which is intended to be inserted into the belt buckle and a safety belt section which has a slot for receiving the safety belt. The safety belt section generally extends in the extension of the insert section, and the slot extends at an angle of less than 25° relative to a plane defined by the insert section. The invention is based on the finding that the slot for the safety belt can be configured obliquely through the safety belt section such that the insert section is positioned closely to the safety belt, when the insert tongue is not used, whilst at the same time the safety belt section can be configured in the extension of the insert section. Thus, the available seating capacity is not limited by the safety belt section. The term "slot" denotes in this arrangement the free space for the passage of the safety belt. As far as the orientation of the slot is concerned, the term "plane of extension" of the slot denotes a plane in which the safety belt extends relative to the insert tongue, when the latter hangs freely on the perpendicularly extending safety belt being kept under tension.

Advantageous designs of the invention will be apparent from the sub-claims.

DETAILED DESCRIPTION OF THE PREFERRED EMBODIMENTS

Figure 1:
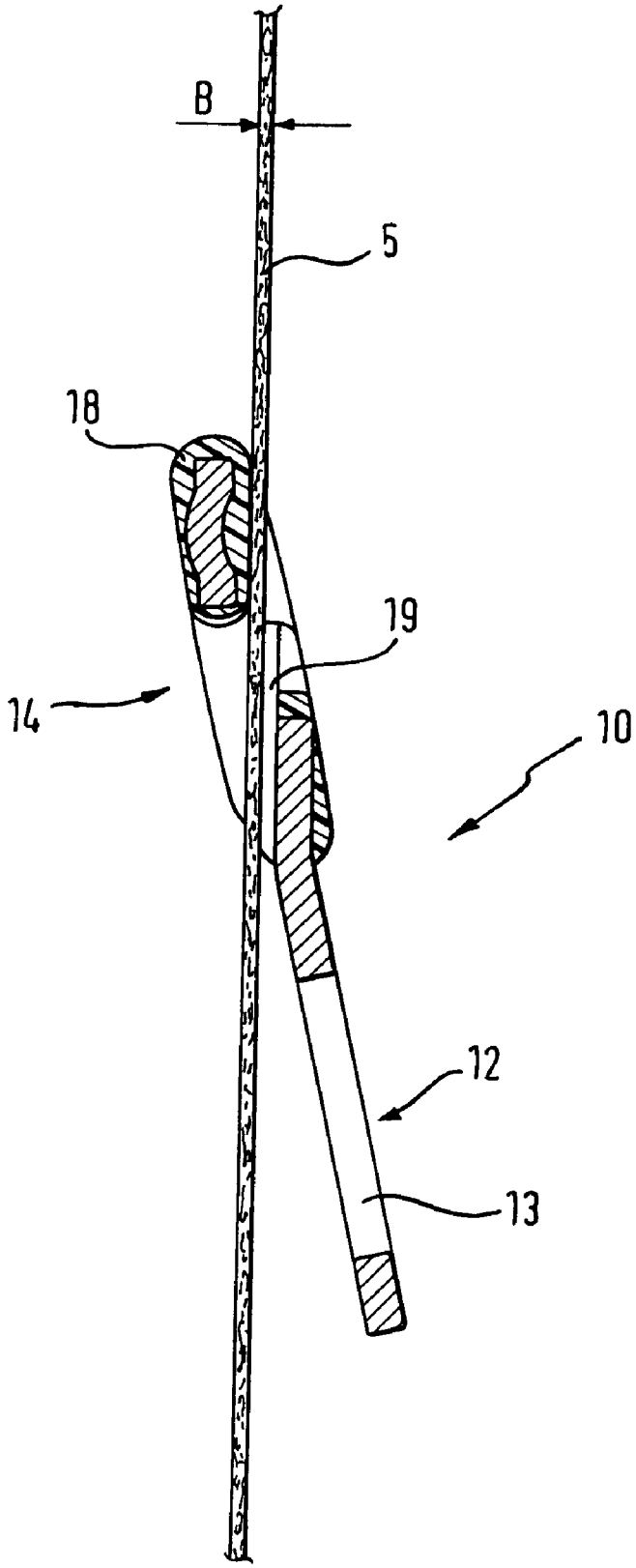
FIG. 1 shows a section through an insert tongue in accordance with a first embodiment of the invention.
Figure 5:
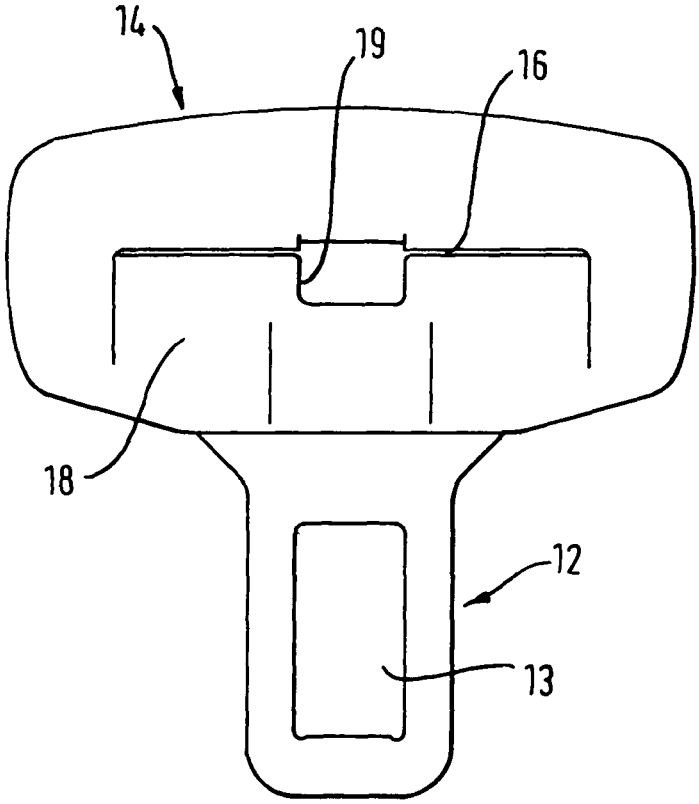
FIG. 5 shows a top view of the insert tongue of FIG. 1.
Figure 6:
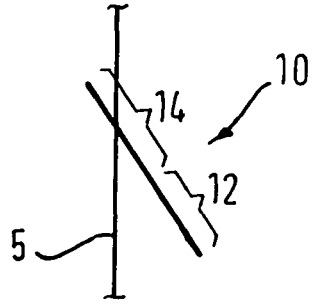
FIG. 6 shows a schematic representation of an insert tongue known from the prior art.
Figure 9:
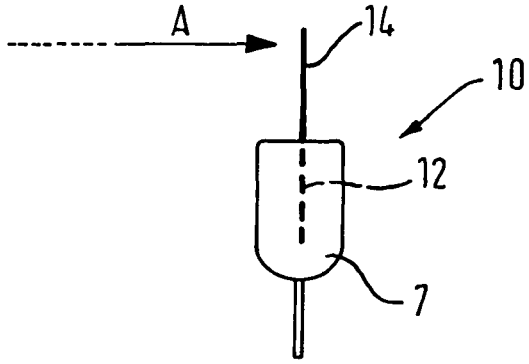
FIG. 9 shows a schematic representation of the insert tongue of FIG. 6 inserted into a belt buckle.

FIG. 1 shows an insert tongue 10 in accordance with a first embodiment of the invention which is disposed on a belt webbing 5. In functional respect, the insert tongue 10 includes an insert section 12 and a safety belt section 14. The insert section 12 is configured in the manner of a tongue having a central opening 13 (see also FIGS. 3 and 5) and intended to be inserted into a belt buckle and to be locked there.

The safety belt section 14 adjoins the insert section 12 and is provided with a slot 16 for the safety belt 5. As measured perpendicularly to its direction of extension which corresponds to the direction of extension of the safety belt 5 in FIG. 1, the slot 16 has a width B of just over 2 mm.

Figure 2:
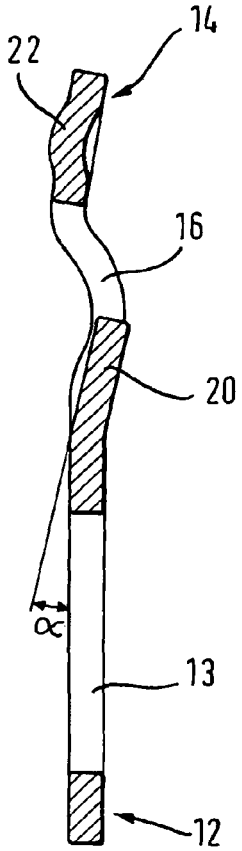
FIG. 2 shows a section through the sheet steel component used with the insert tongue of FIG. 1.
Figure 3:
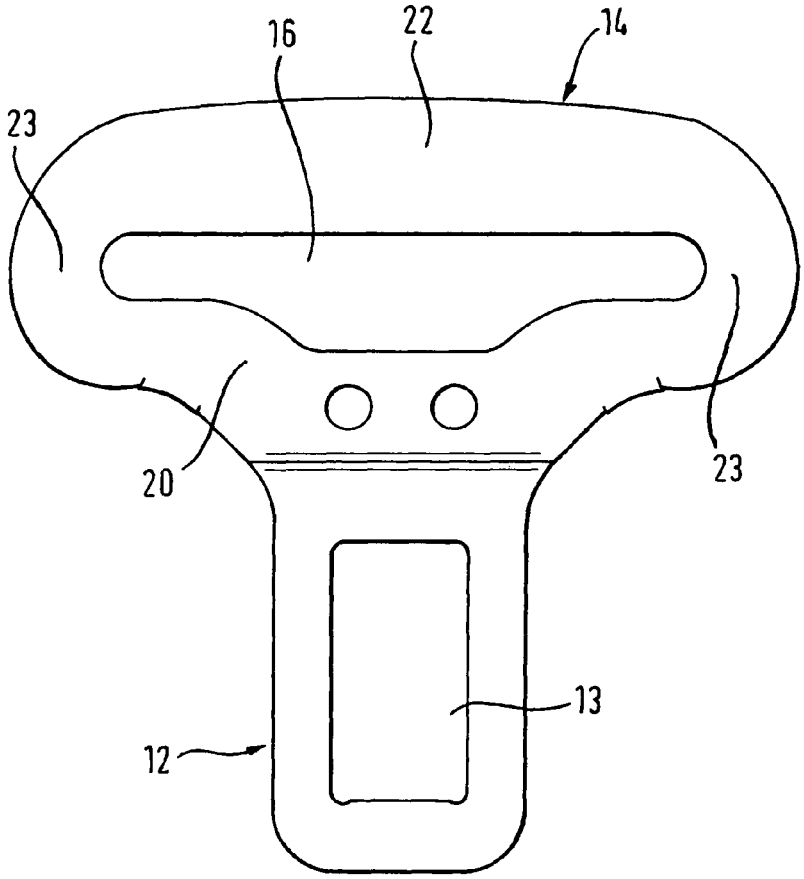
FIG. 3 shows a top view of the sheet steel component used with the insert tongue of FIG. 1.

In structural respect, the insert tongue consists of a stamped sheet metal component that is embodied as a one-piece part and a molded casing of a plastic material 18. The stamped sheet metal component is shown in FIGS. 2 and 3. It forms the insert section 12 and the bearing part of the safety belt section 14. In the region of the safety belt section 14 the stamped sheet metal component is encased with the plastic material 18.

In the region of the safety belt section 14 the stamped sheet metal component includes two lands 20, 22 which delimit the longitudinal edges of the slot 16. The lands are a lower land 20 and an upper land 22 referring to FIGS. 2 and 3. Both lands are substantially flat, apart from a central embossing on the lower land 20 and a stiffening bead on the upper land 22, and bent in such a manner that both extend at approximately the same angle a relative to the plane which is defined by the insert section 12. The angle a is in the order of 15°. It is essential that the two lands 20, 22 are offset from one another such that the extension of the left-hand side of the land 20, with respect to FIG. 2, is on the right-hand side of the upper land 22. In this manner a through slot is formed, the plane of extension of which likewise includes the angle a along with the plane defined by the insert section 12. The lateral offset between the two lands 20, 22, as seen in the passing-through direction of the safety belt 5, is obtained by correspondingly bending the connecting sections 23 between the two lands 20, 22.

Figure 4:
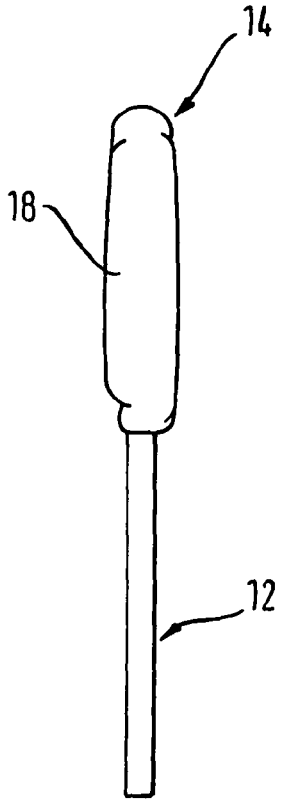
FIG. 4 shows a side view of the insert tongue of FIG. 1.

The molded casing of the lands 20, 22 with the plastic material 18 (see FIGS. 1, 4, and 5) defines the slot 16 for the safety belt 5. A small recess 19 is configured in the plastic material 18 (see FIGS. 1 and 5) for a stop button on the safety belt 5.

Figure 7:
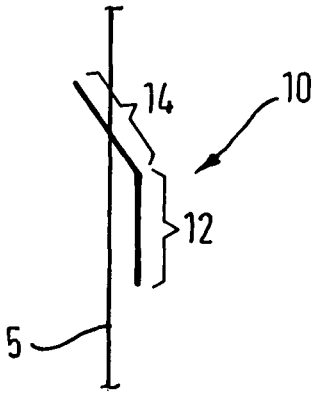
FIG. 7 shows a representation of a further insert tongue known from the prior art.
Figure 8:
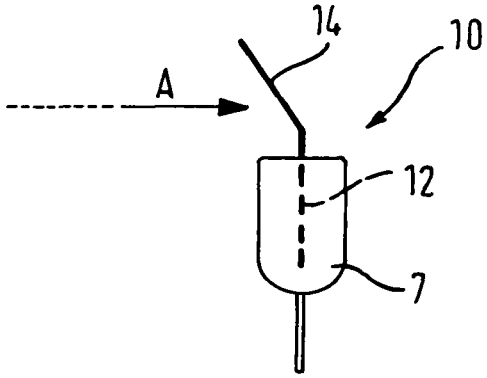
FIG. 8 shows a schematic representation of the insert tongue of FIG. 7 inserted into a belt buckle.
Figure 10:
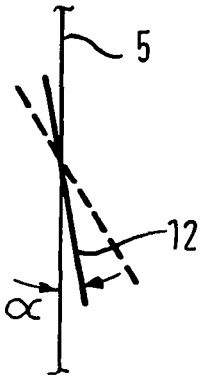
FIG. 10 schematically shows the insert tongue in accordance with the invention on a safety belt.
Figure 11:
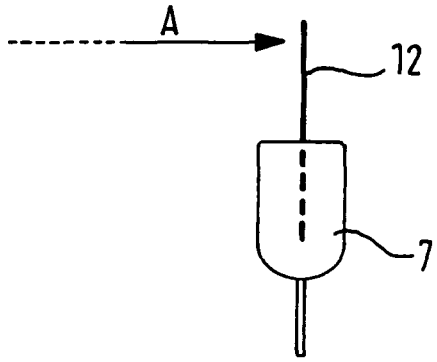
FIG. 11 schematically shows the insert tongue of FIG. 10 inserted into a belt buckle.

It is apparent in FIGS. 10 and 11 that by means of the insert tongue in accordance with the invention a considerably smaller angle a between the insert section 12 of the insert tongue and the safety belt 5 is achieved than this is the case with the insert tongue shown here in a broken line for comparison. Moreover, the width A of the available seating capacity is not limited as compared to the insert tongue shown in FIG. 7.

Figure 12:
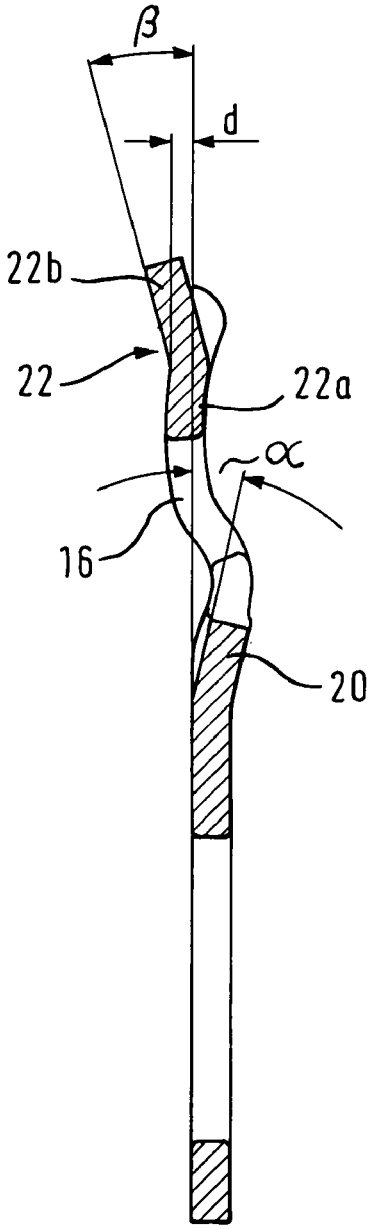
FIG. 12 shows a section through a sheet steel component for an insert tongue in accordance with a second embodiment of the invention.
Figure 13:
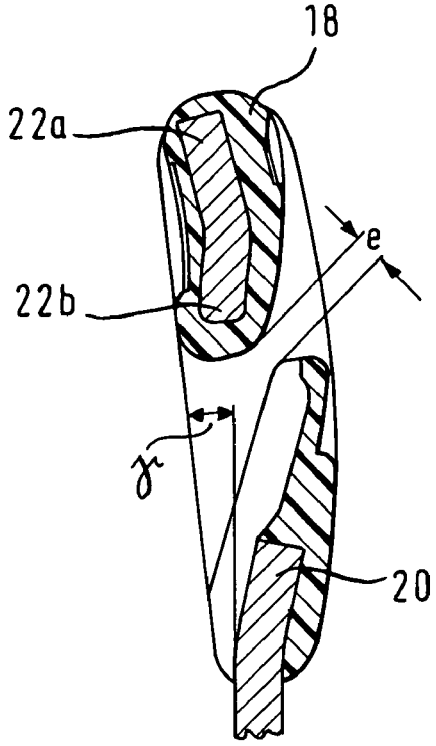
FIG. 13 shows a section through the safety belt section of the insert tongue in accordance with the second embodiment of the invention.

FIGS. 12 and 13 show an insert tongue in accordance with a second embodiment. For features known from the first embodiment, identical reference numerals are used.

The difference between the first embodiment and the second embodiment concerns essentially the upper land 22 which, together with the lower land 20, delimits the longitudinal edges of slot 16. According to the second embodiment, the upper land 22 is neither flat nor provided with a stiffening bead, but consists of two sections 22*a*, 22*b*. Section 22*a* adjoining the slot 16 is cambered, in fact having the same curvature as is generally provided in the upper region of the stamped sheet metal component. This curvature of section 22*a* of the land 22 ensures the required stability in transverse direction.

Section 22*b* which is bent off outwardly adjoins section 22*a*. While section 22*a* extends essentially along the longitudinal axis of the stamped sheet metal component, section 22*b* extends outwardly at an angle β of 10° to 20°, preferably 15°, with respect to the longitudinal axis. In this arrangement, section 22*b* is angled in an opposite direction relative to the slot 16. Referring to FIG. 12, the slot 16 extends obliquely in a top right direction, whereas section 22*b* is bent off obliquely in a top left direction. This design of the land 22 allows the insert portion to get even closer towards the safety belt 5 when the insert tongue 10 is not used. In this case, the angle a known from the first embodiment is in the order of 10° to 15°, preferably 12,5°. Moreover, the safety belt section 14 is outwardly offset relative to the insert section 12, that is to say away from the side where the safety belt upwardly comes out of the slot 16, by an amount d of 1 to 2 mm, preferably 1,5 to 1,7 mm.

The slot 16 for the safety belt 5 has a width e (see FIG. 13) of almost 2 mm, especially 1,9 mm. In the region of the safety belt section 14, an angle y enclosed by the insert section 12 and an outer contour of the molded casing amounts to between 5° and 10°, preferably 6,5°. All those values together represent a good compromise, in which the insert section 12 of the insert tongue 10 is as close to the safety belt 5 as possible when the insert tongue 10 is not used, and the available seating capacity, however, is not limited when the insert tongue 10 is inserted into the belt buckle 7.

The invention claimed is:

1. An insert tongue (10) for a safety belt buckle (7), including an insert section (12) which is intended to be inserted into said belt buckle (7), and a safety belt section (14) which has a single slot (16) for receiving a safety belt (5) such that said safety belt (5) extends straight through said insert tongue (10) when said insert tongue (10) hangs freely on the perpendicularly extending safety belt (5), said safety belt section (14) generally extending along an extension of said insert section (12), said slot (16) and said safety belt (5) extending at an angle (α) of less than 25° relative to a plane defined by said insert section (12) when said insert tongue (10) hangs freely on the perpendicularly extending safety belt (5), longitudinal edges of said slot (16) being defined by first and second lands (20, 22) of said safety belt section (14), both of said first and second lands (20, 22) extending from said insert section at the angle relative to said plane, said first and second lands (20, 22) being offset from each other.

2. The insert tongue according to claim 1, wherein said angle (α) amounts to less than 18°.

3. The insert tongue according to claim 1, wherein said angle (α) amounts to less than 15°.

4. The insert tongue according to claim 1, wherein said safety belt section (14) consists of a metal core including said first and second lands (20, 22) and a plastic casing (18), and wherein said metal core (20, 22) extends in sections obliquely to said plane defined by said insert section (12).

5. The insert tongue according to claim 1, wherein said plane defined by said insert section (12) intersects at least one of said first and second lands (20, 22).

6. The insert tongue according to claim 5, wherein said plane intersects said second land (22) spaced further from said insert section (16) than said first land (20).

7. An insert tongue (10) for a safety belt buckle (7), said insert tongue (10) comprising:

an insert section (12) intended to be inserted into said belt buckle (7); and a safety belt section (14) having a slot (16) through which a safety belt (5) extends, said safety belt (5) lying in a plane extending at an angle less than 25° relative to a plane defined by said insert section (12) when said insert tongue (10) hangs freely on the perpendicularly extending safety belt (5), said safety belt section (14) having a portion extending into said plane defined by said insert section (12), longitudinal edges of said slot (16) being defined by first and second lands (20, 22) of said safety belt section (14), both of said first and second lands (20, 22) extending from said insert section at the angle relative to said plane, said first and second lands (20, 22) being offset from each other.

8. An insert tongue (10) for a safety belt buckle (7), including an insert section (12) which is intended to be inserted into said belt buckle (7), and a safety belt section (14) which has a single slot (16) for receiving a safety belt (5) such that said safety belt (5) extends straight through said insert tongue (10) when said insert tongue (10) hangs freely on the perpendicularly extending safety belt (5), said safety belt section (14) generally extending along an extension of said insert section (12), said slot (16) and said safety belt (5) extending at an angle (α) of less than 25° relative to a plane defined by said insert section (12) when said insert tongue (10) hangs freely on the perpendicularly extending safety belt (5), longitudinal edges of said slot (16) being defined by first and second lands (20, 22) of said safety belt section (14), said first land (20) extending from said insert section at a first angle relative to said plane, said second land (22) extending from said insert section at a second angle relative to said plane, said first and second lands (20, 22) being offset from each other.

9. The insert tongue according to claim 8, wherein at least one of said first and second lands (20, 22) extends at an angle of approximately 15° with respect to said plane defined by said insert section (12).

10. The insert tongue according to claim 9, wherein one of said lands (20, 22) forms an angle.

11. The insert tongue according to claim 10, wherein an exterior section (22*b*) of said second land (22) is angled 10° to 20°.

12. The insert tongue according to claim 11, wherein said exterior section (22*b*) is angled in an opposite direction relative to said slot (16).

13. An insert tongue (10) for a safety belt buckle (7), said insert tongue (10) comprising:

an insert section (12) intended to be inserted into said belt buckle (7); and a safety belt section (14) having a slot (16) through which a safety belt (5) extends, said safety belt (5) lying in a plane extending at an angle less than 25° relative to a plane defined by said insert section (12) when said insert tongue (10) hangs freely on the perpendicularly extending safety belt (5), said safety belt section (14) having a portion extending into said plane defined by said insert section (12), longitudinal edges of said slot (16) being defined by first and second lands (20, 22) of said safety belt section (14), said first land (20) extending from said insert section at a first angle relative to said plane, said second land (22) extending from said insert section at a second angle relative to said plane, said first and second lands (20, 22) being offset from each other.

14. The insert tongue according to claim 13, wherein at least one of said first and second lands (20, 22) extends at an angle of approximately 15° with respect to said plane defined by said insert section (12).

15. The insert tongue according to claim 14, wherein an exterior section (22*b*) of said second land (22) is angled 10° to 20° with respect to said plane defined by said insert section (12).

* * * * *